US006699050B1

(12) United States Patent
Wong et al.

(10) Patent No.: US 6,699,050 B1
(45) Date of Patent: Mar. 2, 2004

(54) LOCKABLE ELECTRICAL OUTLET CLOSURE PLUG

(75) Inventors: Anthony Wong, Franklin, MA (US); Michael Fusco, Johnston, RI (US); Dana E. Chicca, Swansea, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/360,972

(22) Filed: Feb. 7, 2003

(51) Int. Cl.[7] ..... H01R 13/44
(52) U.S. Cl. ..... 439/148; 174/67
(58) Field of Search ..... 439/134, 133, 439/148, 149; 174/66, 67; 220/242, 3.8

(56) References Cited

U.S. PATENT DOCUMENTS

| | | | | |
|---|---|---|---|---|
| 4,159,858 A | | 7/1979 | Toraya | |
| 4,302,624 A | | 11/1981 | Newman | |
| 4,640,564 A | | 2/1987 | Hill | |
| 4,733,017 A | | 3/1988 | Wolfe-Taylor et al. | |
| 5,024,603 A | * | 6/1991 | Hsieh | 439/148 |
| 5,080,599 A | * | 1/1992 | Wimberly | 439/142 |
| 5,240,426 A | | 8/1993 | Barla | |
| 5,320,542 A | * | 6/1994 | Cheng | 439/148 |
| 5,691,507 A | * | 11/1997 | Wei | 174/67 |

FOREIGN PATENT DOCUMENTS

| | | |
|---|---|---|
| GB | 935829 | 9/1963 |
| GB | 2 220 803 A | 1/1990 |

* cited by examiner

*Primary Examiner*—Ross Gushi
(74) *Attorney, Agent, or Firm*—Barnes & Thornburg

(57) ABSTRACT

A lockable electrical outlet socket closure plug includes a plug housing including an inner plate and a socket blade appended to the inner plate and adapted to extend into a blade receiver opening formed in the electrical outlet socket. The closure plug further includes a retainer for selectively retaining the plug housing in a mounted position on an electrical outlet socket and a controller mounted for movement in the plug housing and arranged normally to reinforce the retainer to cause the plug housing to remain in the mounted position on the electrical outlet socket.

28 Claims, 4 Drawing Sheets

LOCKABLE ELECTRICAL OUTLET CLOSURE PLUG

BACKGROUND AND SUMMARY

The present disclosure relates to wall-mounted residential and office electrical outlets, and particularly to closure plugs for those outlets. More particularly, the present disclosure relates to lockable electrical outlet closure plugs.

Electrical outlets usually include upper and lower sockets adapted to admit plugs coupled to the ends of many kinds of electrical cords. Many juvenile caregivers desire to shield young children from access to these sockets and insert a closure plug into a targeted socket or place a socket cover over the targeted socket.

According to the present disclosure, a lockable electrical outlet socket closure plug includes a plug housing and a retainer mounted for movement in the plug housing between locked and unlocked positions. The plug housing includes a pair of socket blades that are adapted to extend into the usual side-by-side blade receiver openings formed in an electrical outlet socket. When moved to the locked position, the retainer engages a flange associated with a ground prong receiver opening in an electrical outlet socket to retain the plug housing in a mounted position shielding the socket. When moved to the unlocked position, the retainer disengages the flange in the socket to release the plug housing so that it can be removed by a caregiver from the electrical outlet socket.

In illustrative embodiments, the plug further includes a controller mounted for movement in the plug housing and arranged normally to "reinforce" the retainer so that the retainer cannot be moved from the locked position to the unlocked position. When the caregiver elects to remove the plug housing from the electrical outlet socket, the caregiver first moves the controller relative to the plug housing to "release" the retainer and the caregiver then moves the released retainer from the locked position to the unlocked position to allow the caregiver to remove the plug housing from the electrical outlet socket.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
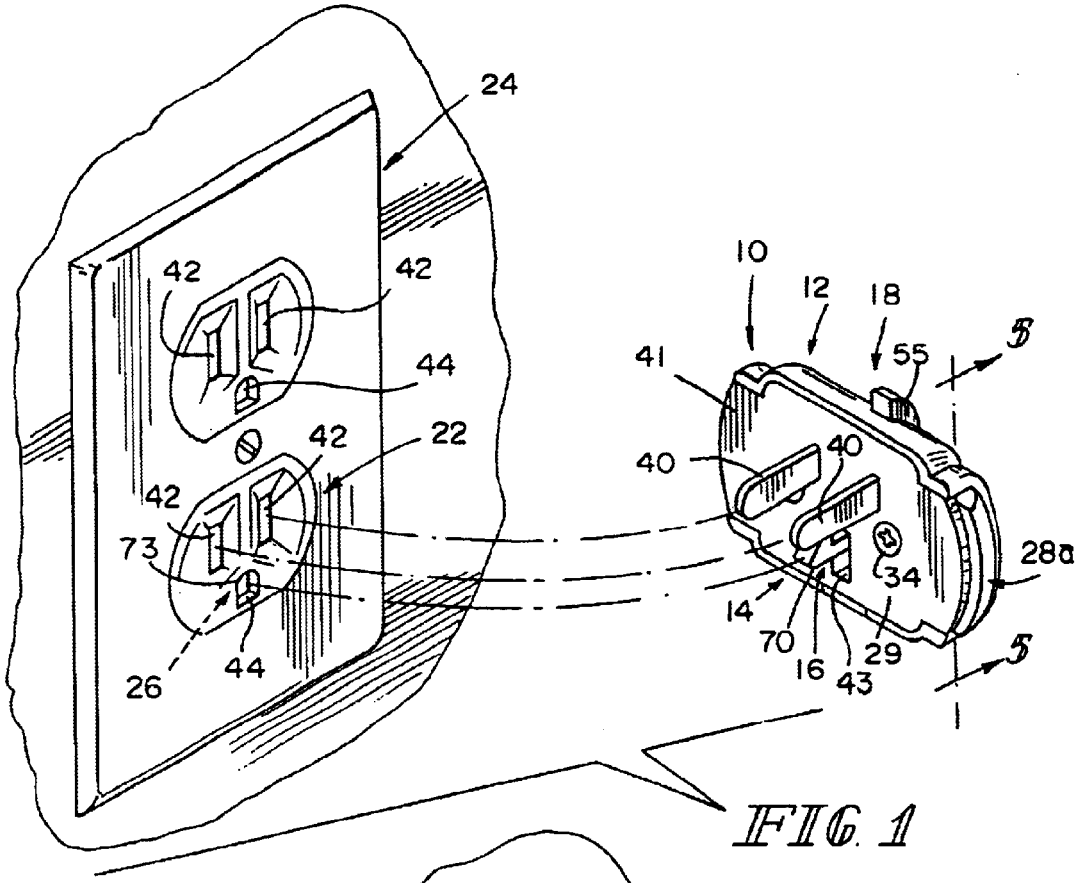
FIG. 1 is a perspective view of an electrical outlet socket closure plug in accordance with the present disclosure and an electrical outlet socket adapted to receive the plug and showing a retainer mounted for movement in the plug and adapted to extend into a ground prong receiver formed in the socket to retain the plug in a mounted position in the socket.
Figure 2:
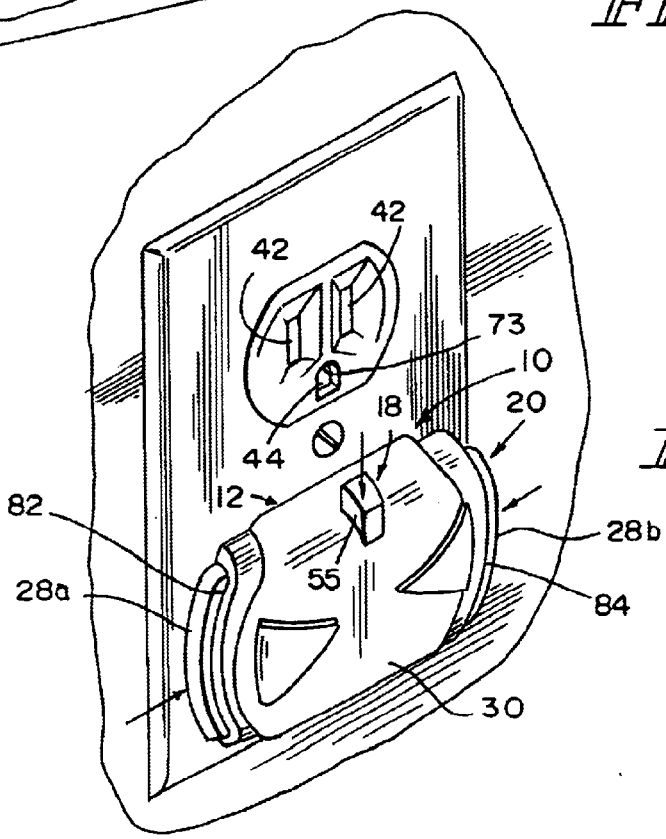
FIG. 2 is a perspective view similar to FIG. 1 showing a plug housing included in the plug locked in a mounted position in the socket and showing a controller including a pair of finger pads that can be moved manually toward one another to free the retainer so that it can be moved relative to the plug housing and the socket and also including an actuator (protruding from an aperture formed in an outer plate of the plug housing) that can be moved manually downwardly (while the finger pads are moved toward one another to positions in the plug housing) to disengage the retainer from the socket so that the plug can be removed from the socket.

A closure plug 10 includes a plug housing 12, a retainer 14 including a retainer latch 16 and a latch actuator 18, and a latch controller 20 as shown, for example, in FIGS. 1–4. During installation, closure plug 10 is inserted into openings formed in an outlet socket 22 of an electrical outlet 24 in the manner suggested in FIG. 1. Retainer latch 16 engages a latch flange 26 associated with one of the openings once closure plug 10 is mounted on electrical outlet 24 in the manner shown in FIG. 2 to retain closure plug 10 in a releasable but fixed position on electrical outlet 24 as shown, for example, in FIGS. 5 and 8. By first "squeezing" finger pads 28*a* and 28*b* included in latch controller 20 together (as suggested in FIGS. 2, 6, 7, 9, and 10) and then pushing down on latch actuator 18 (as suggested in FIGS. 2, 7, and 10), retainer latch 16 can be moved to disengage latch flange 26 thereby releasing closure plug 10 from electrical outlet 24.

Plug housing 12 includes an inner plate 29 and an outer plate 30 configured to mate with inner plate 29 to form an interior region 32 therebetween containing portions of retainer 14 and latch controller 20 as suggested in FIGS. 3 and 8–10. Fasteners 34 pass through openings 35 formed in inner plate 29 and collars 36 appended to an interior surface 37 of inner plate 29 and into bores 38 formed in fastener mount posts 39 to anchor inner plate 29 in a fixed position on outer plate 30 as suggested in FIGS. 1, 3, and 4.

Figure 4:
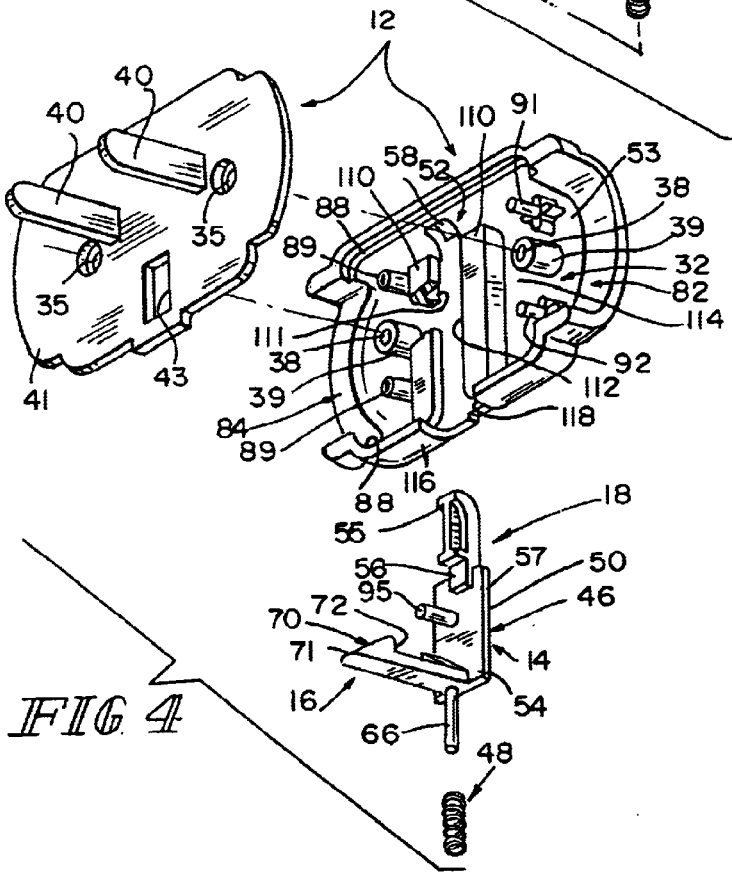
FIG. 4 is a perspective view of the inner plate, outer plate, and retainer taken from another point of view showing how the latch carrier can slide upwardly into a vertically extending channel formed in a retainer mount appended to an interior surface of the outer plate.

A pair of socket blades 40 are appended to an exterior surface 41 of inner plate 29 as shown, for example, in FIGS. 1 and 4. Each socket blade 40 is adapted to extend into one of the blade receiver openings 42 formed in socket 22 of electrical outlet 24. Inner plate 29 is formed to include a retainer latch opening 43 adapted to confront a ground prong receiver opening 44 formed in electrical outlet socket 22 following insertion of the pair of socket blades 40 into the blade receiver openings 42.

Figure 3:
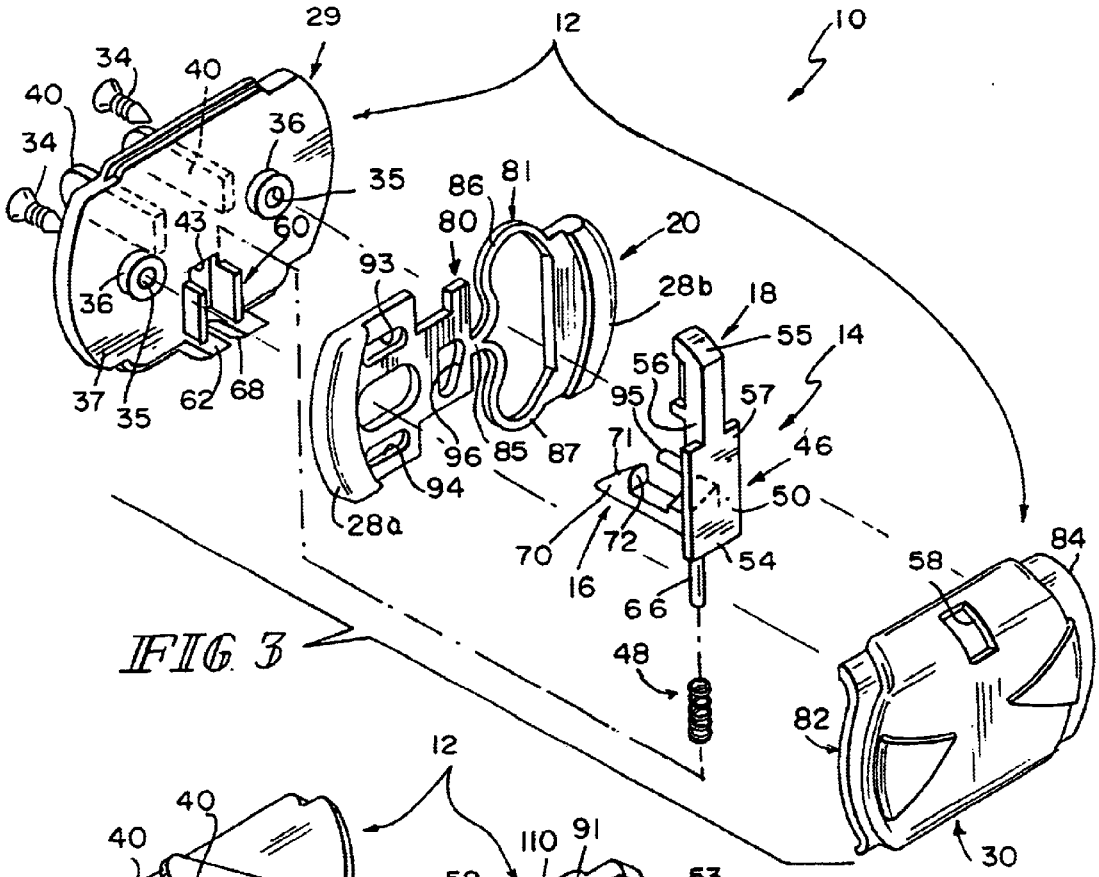
FIG. 3 is a perspective view of components that can be assembled to produce the electrical outlet socket closure plug of FIGS. 1 and 2 and showing (from right to left) an outer plate formed to include an actuator-receiving aperture, a retainer including a vertically extending latch carrier and a horizontally extending retainer latch cantilevered to the latch carrier, a coiled latch carrier return spring below the latch carrier, a latch controller including the two finger pads, and a plug base including an inner plate and two socket blades (shown in phantom) appended to an exterior surface of the inner plate.

Retainer 14 also includes a latch carrier 46 and a latch carrier return spring 48 as shown, for example, in FIGS. 3 and 4. Latch carrier 46 includes a carrier body 50 that is sized and shaped to slide up and down in a retainer mount 52 appended to an interior surface 53 of outer plate 30. In the illustrated embodiment, carrier body 50 is a thin, flat plate. Retainer latch 16 is coupled to a lower end 54 of carrier body 50 and latch actuator 18 comprising a head 55 and a neck 56 is coupled to an upper end 57 of carrier body 50.

Figure 5:
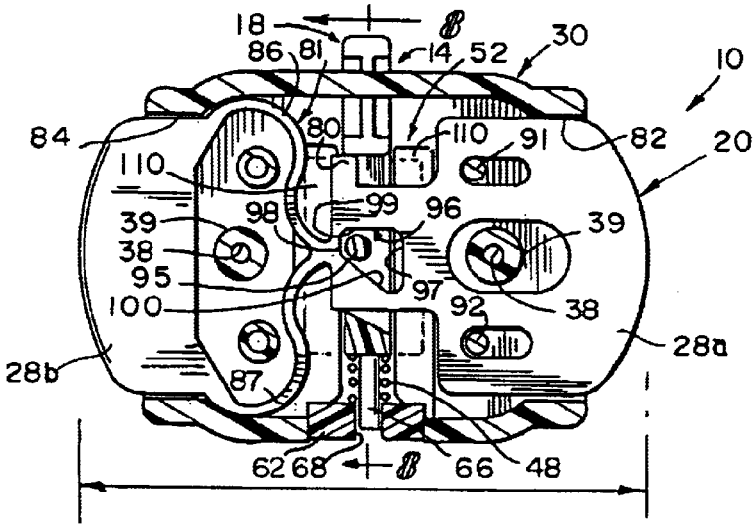
FIG. 5 is a sectional view taken along line 5—5 of FIG. 1 showing operation of the coiled latch carrier return spring to move the latch carrier upwardly to cause the retainer latch carried on the latch carrier to engage a retainer flange associated with the socket as shown in FIG. 8 to retain the plug in a mounted position in the socket and showing positioning of a retainer motion blocker located in a middle portion of the latch controller to block downward movement of the latch carrier to maintain engagement of the retainer latch and the socket.
Figure 6:
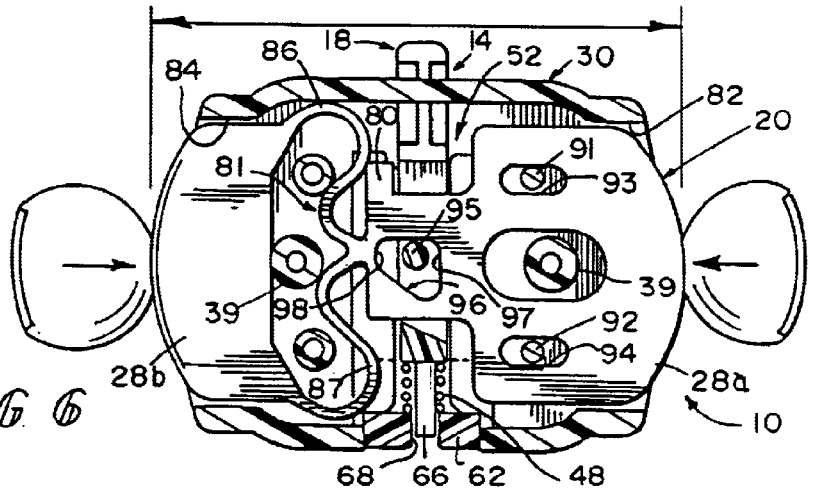
FIG. 6 is a sectional view similar to FIG. 5 showing movement of the finger pads of the latch controller toward one another to disengage the retainer motion blocker from the latch carrier to free the latch carrier so that it can be moved downwardly against the underlying coiled latch carrier return spring.
Figure 7:
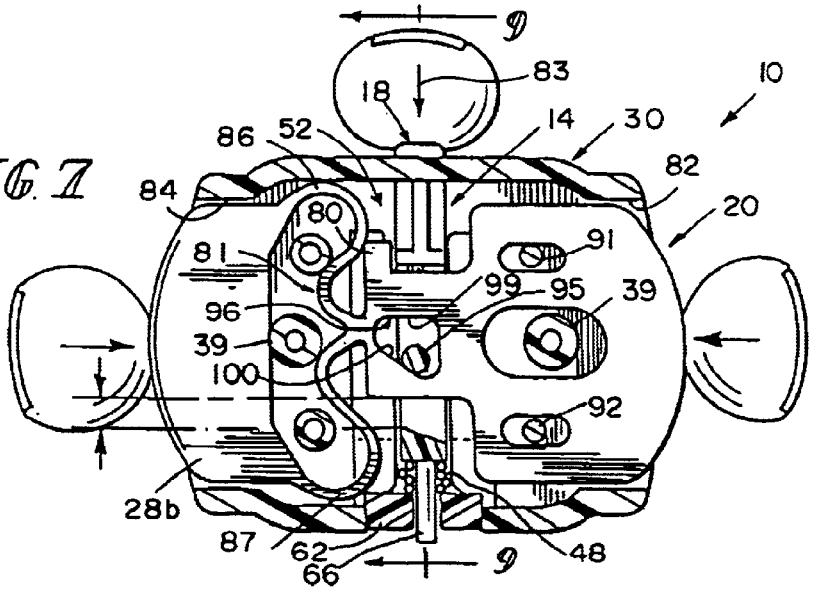
FIG. 7 is a sectional view similar to FIGS. 5 and 6 showing downward movement of the latch carrier against an upward force applied by the coiled latch carrier return spring in response to a downward force applied to the protruding actuator while the finger pads are "held" in the positions shown in FIG. 6 to cause the retainer latch carried on the latch carrier to disengage the retainer flange associated with the socket as shown in FIG. 9 to "release" the plug from its mounted position so that it can be removed from the socket.
Figure 8:
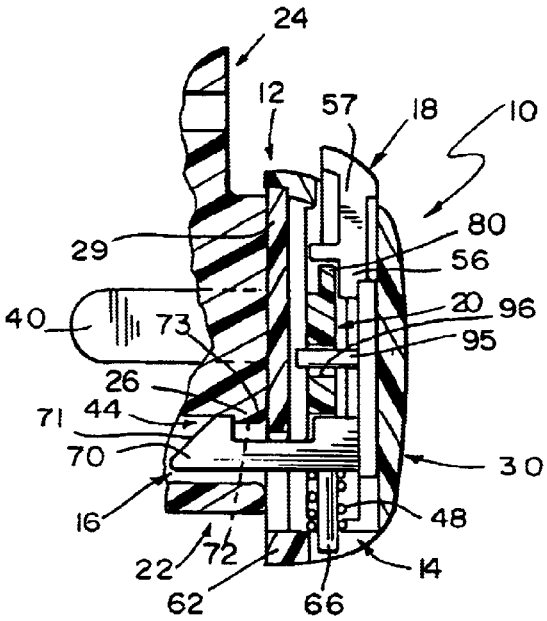
FIG. 8 is a sectional view taken along line 8—8 of FIG. 5 showing engagement of a lug on the retainer latch and a retainer flange associated with the socket to block separation of the plug from the electrical outlet socket.
Figure 9:
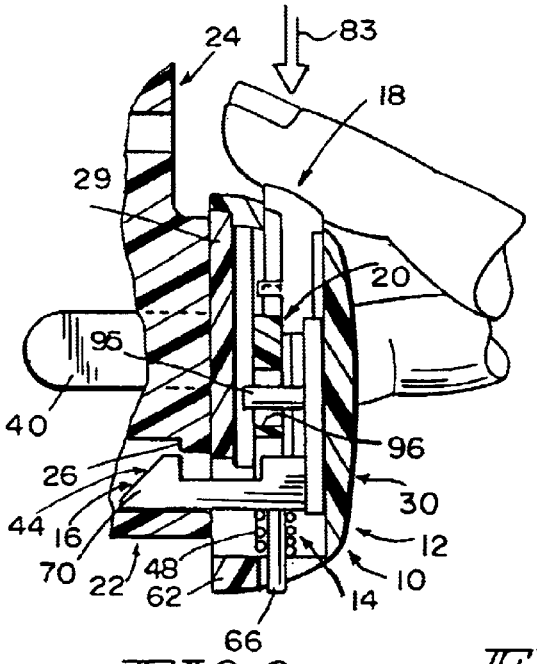
FIG. 9 is a sectional view taken along line 9—9 of FIG. 7 showing disengagement of the lug on the retainer latch from the retainer flange associated with the socket to allow separation of the outlet plug from the electrical outlet socket.
Figure 10:
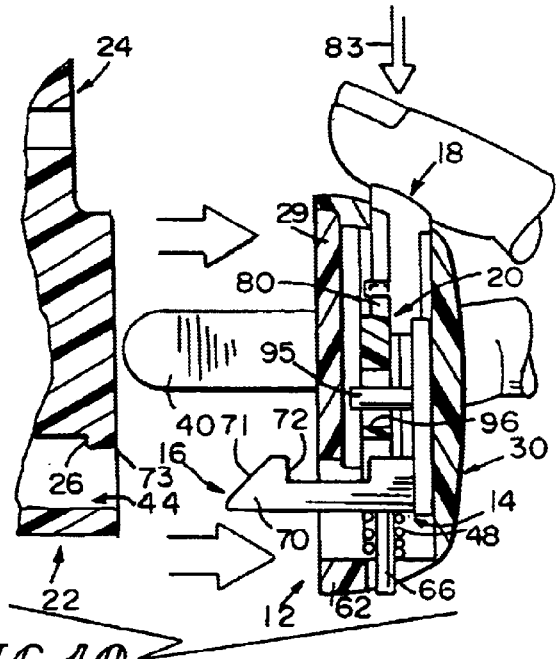
FIG. 10 is a sectional view similar to FIG. 9 showing separation of the plug from the electrical outlet socket.

Retainer mount 52 on outer plate 30 is configured to receive and support latch carrier 46 for sliding movement relative to inner plate 29 between a locked position shown in FIGS. 2, 5, 6, 8, and 9 and an unlocked position shown in FIGS. 7 and 10. In the locked position, retainer latch 16 is adapted to engage retainer flange 26 provided in ground prong receiver opening 44 formed in electrical outlet socket 22 to block movement of inner plate 29 and socket blades 40 away from socket 22. In the unlocked position, retainer latch 16 is adapted to disengage latch flange 26 to allow movement of inner plate 29 and socket blades 40 away from socket 22.

Latch carrier return spring 48 is arranged in plug housing 12 to yieldably urge latch carrier 46 normally to the locked position to cause latch actuator 18 to extend upwardly through an actuator aperture 58 formed in outer plate 30 to provide means outside of plug housing 12 for manually moving latch carrier 46 against latch carrier return spring 48 from the locked position to the unlocked position (as suggested in FIGS. 7 and 10). Such movement causes retainer latch 16 to disengage latch flange 26 of electrical outlet socket 22 so that plug housing 12 can be removed from electrical outlet socket 22.

Plug housing also includes a spring holder 60 coupled to interior surface 37 of inner plate 29 and configured to receive latch carrier return spring 48 therein as suggested in FIGS. 3 and 5. Spring holder 60 includes a spring support floor 62 cantilevered to interior surface 37 and arranged to lie along a lower edge of retainer latch opening 43 and a lower end of latch carrier return spring 48 engages spring support floor 62. Spring holder 60 further includes a pair of spring support walls 64 arranged to lie in spaced-apart relation to one another to locate retainer latch opening 43 therebetween and to extend upwardly from spring support floor 62 as shown, for example, in FIG. 3.

Retainer 14 also includes a cantilevered spring guide 66 coupled to an underside of retainer latch 16 as shown, for example, in FIGS. 3 and 4. In the illustrated embodiment, latch carrier return spring 48 is a coil configured to wind around cantilevered spring guide 66 and arranged to engage the underside of retainer latch 16. As shown in FIG. 3, spring support floor 62 is formed to include a spring guide receiver slot 68 and a distal portion of cantilevered spring guide 66 extends below coil 48 and into and through spring guide receiver slot 68 as suggested in FIGS. 5–10.

As suggested in FIGS. 3 and 4, retainer latch 16 includes an inner end that is cantilevered to lower end 54 of carrier body 50 and is mated to an upper end of spring guide 66. An outer end of retainer latch 16 is formed to include an inclined cam ramp 71 and a vertical flange retainer surface 72. During installation of closure plug 10 on electrical outlet 24, inclined cam ramp 71 is arranged to engage an outer edge 73 of electrical outlet socket 22 as suggested in FIGS. 1 and 8 to bend the deflectable, cantilevered retainer latch 16 downwardly to pass lug 70 under outer edge 73 and then allow lug 70 to "snap" upwardly into the locked position shown in FIG. 8 owing to the "springiness" of the material used to form retainer latch 16. In this locked position, vertical flange retainer surface 72 of lug 70 engages flange 26 to retain closure plug 10 in the mounted position on electrical outlet 24 shown in FIGS. 2 and 8.

Latch controller 20 is illustrated in FIG. 3 and includes a retainer motion blocker 80 and a blocker return spring 81 positioned to lie between the finger pads 28*a* and 28*b*. Retainer motion blocker 80 is coupled to first finger pad 28*a* and mounted for movement in interior region 32 of plug housing 12 between a latch-locking position (shown in FIGS. 5 and 8) blocking movement of latch carrier 46 from the locked position to the unlocked position and a latch-releasing position (shown in FIGS. 6, 7, 9, and 10) allowing movement of latch carrier 46 from the locked position to the unlocked position. Blocker return spring 81 is also located in interior region 32 of plug housing 12 and arranged yieldably to urge retainer motion blocker 80 normally to the latch-locking position. Latch controller 20 is configured to provide means for normally blocking movement of retainer 16 from the locked position to the unlocked position to cause retainer 16 to remain in engagement with retainer flange 26 so that plug housing 12 is retained in a mounted position on the electrical outlet socket 22 and for selectively releasing retainer 16 so that retainer 16 can be moved from the locked position to the unlocked position to cause retainer 16 to be released from engagement with retainer flange 26 to allow plug housing 12 to be dismounted from electrical outlet socket 22.

First finger pad 28*a* is coupled to retainer motion blocker 80 as shown, for example, in FIG. 3. First finger pad 28*a* is arranged to extend and move through a first side opening 82 formed in plug housing 12 to provide means for manually moving retainer motion blocker 80 against a biasing force generated by blocker return spring 81 to urge retainer motion blocker 80 upwardly to the latch-releasing position (shown in FIG. 6) so that latch carrier 46 is free to move to the unlocked position in response to movement of latch actuator 18 in a downward direction 83 toward latch carrier return spring 48. Second finger pad 28*b* is coupled to latch carrier return spring 48 and arranged to extend and move through a second side opening 84 formed in plug housing 12 as shown, for example, in FIGS. 2 and 5.

As suggested in FIG. 3, a monolithic member is configured to define first and second finger pads 28*a* and 28*b*, retainer motion blocker 80, and blocker return spring 81. In one embodiment, that monolithic member is made of a plastics material. In the illustrated embodiment, retainer motion blocker 80 is positioned to lie between blocker return spring 81 and first finger pad 28*a*.

As suggested in FIG. 3, blocker return spring 81 is a compliant Y-shaped strip having a center leg 85 coupled to retainer motion blocker 80 and a pair of arms 86, 87. Each arm 86, 87 has a first end coupled to center leg 85 and a second end arranged to contact an inner wall 88 of outer plate 30. Each arm 86, 87 has a serpentine shape in the illustrated embodiment. Each arm 86, 87 has a second end coupled to second finger pad 28*b*.

As shown in FIG. 4, two slide posts 91, 92 are coupled to an interior surface of outer plate 30 and arranged to lie in interior region 32 between inner and outer plates 29, 30. First finger pad 28*a* is formed to include a pair of slide post receiver guide slots 93, 94 as shown in FIG. 3. Each slide post 91, 92 is arranged to extend into one of the slide post receiver guide slot 93, 94 and move back and forth therein during movement of first and second finger pads 28*a* and 28*b* toward and away from blocker return spring 81 as shown in FIGS. 5–7. Slide posts 91, 92 are arranged to engage first finger pad 28*a* as shown in FIG. 5 to limit movement of first finger pad 28*a* and retainer motion blocker 80 relative to latch carrier 46 to locate retainer motion blocker 80 normally in the latch-locking position. Fixed support posts 89 are cantilevered to interior surface 53 of outer plate 30 and arranged to locate one of the fastener mount posts 39 therebetween as shown in FIG. 4 to provide means for supporting inner plate 29 relative to outer plate 30.

Retainer 14 also includes a motion-limiter post 95 as shown, for example, in FIGS. 3–5. Motion-limiter post 95 is coupled to carrier body 50 of latch carrier 46 and arranged to extend toward inner plate 29. Retainer motion blocker 80 includes an interior edge 96 defining an opening receiving motion-limiter post 95 therein as shown, for example, in FIGS. 5–8. Motion-limiter post 95 is arranged to engage interior edge 96 to limit movement of retainer motion blocker 80 relative to latch carrier 46 to locate retainer motion blocker 80 normally in the latch-blocking position.

As shown in FIG. 5, interior edge 96 of retainer motion blocker 80 has a trapezoidal shape and includes a long base wall 97 in spaced-apart relation to blocker return spring 81, a short base wall 98 located between blocker return spring 81 and long base wall 97, a horizontally extending wall 99 interconnecting upper ends of long and short base walls 97, 98, and a diagonally extending wall 100 interconnecting lower ends of long and short base walls 97, 98. This trapezoidal shape of interior edge 96 provides means for allowing travel of motion-limiter post 95 in the opening "96" along long base wall 97 between horizontally and diagonally extending walls 99, 100 during movement of latch carrier 46 between the locked and unlocked positions.

As shown in FIG. 4, retainer mount 52 includes a pair of L-shaped flanges 110 positioned to lie in confronting spaced-apart parallel relation to one another to define a wide-mouth channel 111 receiving carrier body 50 for sliding movement therein and a narrow-mouth channel 112 receiving retainer latch 16 for sliding movement therein during movement of latch carrier 46 between the locked and unlocked positions. L-shaped flanges 110 are configured to cause the wide-mouth channel 111 to have a width that is greater than a width of the narrow-mouth channel 112. Outer plate 30 includes a side wall 114 appended to L-shaped flanges 110 and a lower wall 116 arranged to extend between side wall 114 and the inner plate 29 and formed to include an opening 118 into the wide-mouth channel 111 sized to admit carrier body 50 into the wide-mouth channel 111.

What is claimed is:

1. A lockable electrical outlet socket closure plug comprising a plug housing including an inner plate and a pair of socket blades appended to the inner plate and adapted to extend into blade receiver openings formed in an electrical outlet socket, the inner plate being formed to include a retainer latch opening adapted to confront a ground prong receiver opening formed in the electrical outlet socket following insertion of the pair of socket blades into the blade receiver openings, a retainer including a latch carrier and a retainer latch arranged on the latch carrier to extend through the retainer latch opening formed in the inner plate and adapted to extend into the ground prong receiver opening formed in the electrical outlet socket, the plug housing further including a retainer mount configured to receive and support the latch carrier for sliding movement relative to the inner plate between a locked position wherein the retainer latch is adapted to engage a latch flange provided in the ground prong receiver opening formed in the electrical socket outlet to block movement of the inner plate and the pair of socket blades appended to the inner plate away from the electrical outlet socket and an unlocked position wherein the retainer latch is adapted to disengage the latch flange to allow movement of the inner plate and socket blades away from the electrical outlet socket, the retainer further including a latch carrier return spring arranged in the plug housing to yieldably urge the latch carrier normally to the locked position to cause a latch actuator portion of the latch carrier to extend upwardly through an actuator aperture formed in the plug housing to provide means outside of the plug housing for manually moving the latch carrier against the latch carrier return spring from the locked position to the unlocked position to cause the retainer latch to disengage the latch flange so that the plug housing can be removed from the electrical outlet socket, and a latch controller mounted for movement in the plug housing and arranged normally to block movement of the latch carrier from the locked position to the unlocked position to cause the retainer latch to remain in engagement with the latch flange.

2. The plug of claim 1, wherein the inner plate includes an exterior surface and an opposite interior surface, the socket blades are appended to the exterior surface, and the plug housing further includes a spring holder coupled to the interior surface of the inner plate and configured to receive the latch carrier return spring therein.

3. The plug of claim 2, wherein the spring holder includes a spring support floor cantilevered to the interior surface and arranged to lie along a lower edge of the retainer latch opening and a lower end of the latch return spring engages the spring support floor.

4. The plug of claim 3, wherein the spring holder further includes a pair of spring support walls arranged to lie in spaced-apart relation to one another to locate the retainer latch opening therebetween and to extend upwardly from the spring support floor.

5. The plug of claim 3, wherein the retainer further includes a cantilevered spring guide coupled to an underside of the retainer latch, the latch carrier return spring is a coil configured to wind around the cantilevered spring guide and arranged to engage the underside of the retainer latch, the spring support floor includes a spring guide receiver slot, and a distal portion of the cantilevered spring guide extends below the coil and through the spring guide receiver slot.

6. The plug of claim 1, wherein the plug housing further includes an outer plate coupled to the inner plate to contain portions of the latch carrier and latch controller therebetween, the inner plate is arranged to lie between the socket blades and the outer plate, the outer plate is formed to include the actuator aperture, the inner and outer plates cooperate to define a first side opening therebetween, and a first portion of the latch controller extends through the first side opening to lie outside of an interior region defined between the inner and outer plates.

7. The plug of claim 6, wherein the inner and outer plates cooperate to define a second side opening therebetween and a second portion of the latch controller extends through the second side opening to lie outside of the interior region.

8. The plug of claim 7, wherein the latch controller further includes a retainer motion blocker coupled to the first portion of the latch controller and mounted for movement in the interior region between a latch-locking position blocking movement of the latch carrier from the locked position to the unlocked position and a latch-releasing position allowing movement of the latch carrier from the locked position to the unlocked position, the latch controller further includes a blocker return spring coupled to the second portion of the latch controller and to the retainer motion blocker and located in the interior region, and the blocker return spring is arranged yieldably to urge the retainer motion blocker normally to the latch-locking position.

9. The plug of claim 1, wherein the latch carrier includes a carrier body disposed in sliding engagement in the retainer mount, the latch actuator portion is appended to an upper end of the carrier body, and the retainer latch is cantilevered to a lower end of the carrier body.

10. The plug of claim 9, wherein the plug housing further includes an outer plate coupled to the inner plate to contain portions of the latch carrier and latch controller therebetween, the inner plate is arranged to lie between the socket blades and the outer plate, the outer plate is formed to include the actuator aperture, the outer plate includes an interior surface facing toward the inner plate, and the retainer mount is appended to the interior surface.

11. The plug of claim 10, wherein the retainer mount includes a pair of L-shaped flanges positioned to lie in confronting spaced-apart parallel relation to one another to define a wide-mouth channel receiving the carrier body for sliding movement therein and a narrow-mouth channel receiving the retainer latch for sliding movement therein during movement of the latch carrier between the locked and unlocked positions and the L-shaped flanges are configured to cause the wide-mouth channel to have a width that is greater than a width of the narrow-mouth channel.

12. The plug of claim 11, wherein the outer plate includes a side wall appended to the L-shaped flanges and a lower wall arranged to extend between the side wall and the inner plate and formed to include an opening into the wide-mouth channel sized to admit the carrier body into the wide-mouth channel.

13. The plug of claim 1, wherein the retainer mount is formed to include a channel receiving a portion of the latch carrier for sliding movement therein, the plug housing further includes an outer plate coupled to the inner plate to contain certain portions of the latch carrier and latch controller therein, the inner plate is arranged to lie between the socket blades and the outer plate, and the outer plate includes a side wall carrying the retainer mount thereon and a lower wall arranged to extend between the side wall and the inner plate and formed to include an opening into the channel sized to admit the latch carrier into the channel.

14. The plug of claim 13, wherein the inner plate includes an exterior surface and an opposite interior surface, the socket blades are appended to the exterior surface, and the plug housing further includes a spring holder coupled to the interior surface of the inner plate and configured to receive the latch carrier return spring therein, the spring holder includes a spring support floor cantilevered to the interior surface and arranged to lie along a lower edge of the retainer latch opening, a lower end of the latch return spring engages the spring support floor, and the spring support floor is sized to fit into the opening formed in the lower wall of the outer plate.

15. The plug of claim 14, wherein the retainer further includes a cantilevered spring guide coupled to an underside of the retainer latch, the latch carrier return spring is a coil configured to wind around the cantilevered spring guide and arranged to engage the underside of the retainer latch, the spring support floor includes a spring guide receiver slot, and a distal portion of the cantilevered spring guide extends below the coil and through the spring guide receiver slot.

16. The plug of claim 1, wherein the plug housing is formed to include a first side opening and the latch controller includes a retainer motion blocker mounted for movement in an interior region formed in the plug housing between a latch-locking position blocking movement of the latch carrier from the locked position to the unlocked position and a latch-releasing position allowing movement of the latch carrier from the locked position to the unlocked position, a blocker return spring located in the interior region and arranged yieldably to urge the retainer motion blocker to the latch-locking position, and a first finger pad coupled to the retainer motion blocker and arranged to extend through the first side opening formed in the plug housing to provide means for manually moving the retainer motion blocker against a biasing force generated by the blocker return spring to urge the retainer motion blocker to the latch-releasing position so that the latch carrier is free to move to the unlocked position in response to movement of the latch actuator portion in a direction toward the latch carrier return spring.

17. The plug of claim 16, wherein a monolithic member is configured to define the blocker return spring, the retainer motion blocker, and the finger pad.

18. The plug of claim 17, wherein the monolithic member is made of a plastics material.

19. The plug of claims 16, wherein the retainer motion blocker is positioned to lie between the blocker return spring and the first finger pad.

20. The plug of claim 16, wherein the blocker return spring is a compliant Y-shaped strip having a center leg coupled to the retainer motion blocker and a pair of arms and each arm has a first end coupled to the center leg and a second end arranged to contact an inner wall of the outer plate.

21. The plug of claim 20, wherein each arm has a serpentine shape.

22. The plug of claim 20, wherein the latch controller further includes a second finger pad arranged to interconnect the second ends of the arms and to extend through a second side opening formed in the plug housing.

23. The plug of claim 16, wherein the plug housing includes an outer plate and a slide post coupled to the outer plate and arranged to lie in an interior region formed in the plug housing between the inner and outer plates, the first finger pad is formed to include a slide post receiver guide slot, and the slide post is arranged to extend into the slide post receiver guide slot and move back and forth therein during back and forth movement of the first finger pad toward and away from the blocker return spring.

24. The plug of claim 23, wherein the slide post is arranged to engage the first finger pad to limit movement of the first finger pad and retainer motion blocker relative to the latch carrier to locate the retainer motion blocker normally in the latch-locking position.

25. The plug of claim 16, wherein the retainer further includes a motion-limiter post coupled to the latch carrier and arranged to extend toward the inner plate, the retainer motion blocker includes an interior edge defining an opening receiving the motion-limiter post therein, and the motion-limiter post is arranged to engage the interior edge to limit movement of the retainer motion blocker relative to the latch carrier to locate the retainer motion blocker normally in the latch-blocking position.

26. The plug of claim 25, wherein the interior edge includes a long base wall in spaced-apart relation to the blocker return spring, a short base wall located between the blocker return spring and the long base wall, a horizontally extending wall interconnecting upper ends of the long and short base walls, and a diagonally extending wall interconnecting lower ends of the long and short base walls to allow travel of the motion-limiter post in the opening along the long base wall and between the horizontally and diagonally extending walls during movement of the latch carrier between the locked and unlocked positions.

27. A lockable electrical outlet socket closure plug comprising a plug housing including an inner plate and a socket blade appended to the inner plate and adapted to extend into a blade receiver opening formed in the electrical outlet socket, a retainer mounted for movement relative to the plug housing between a locked position wherein the retainer is adapted to engage a retainer flange associated with a ground prong receiver opening formed in the electrical socket outlet to block movement of the inner plate and the socket blades from the electrical outlet socket and an unlocked position wherein the retainer is adapted to disengage the retainer flange to allow movement of the inner plate and socket blades away from the electrical outlet socket, and means for normally blocking movement of the retainer from the locked position to the unlocked position to cause the retainer to remain in engagement with the retainer flange so that the plug housing is retained in a mounted position on the electrical outlet socket and for selectively releasing the retainer so that the retainer can be moved from the locked position to the unlocked position to cause the retainer to be released from engagement with the retainer flange to allow the plug housing to be dismounted from the electrical outlet socket.

28. A lockable electrical outlet socket closure plug comprising a plug housing including an inner plate and a socket blade appended to the inner plate and adapted to extend into a blade receiver opening formed in the electrical outlet socket, retainer means for selectively retaining the plug housing in a mounted position on an electrical outlet socket, and a controller mounted for movement in the plug housing and arranged normally to reinforce the retainer means to cause the plug housing to remain in the mounted position on the electrical outlet socket.

* * * * *